US007793485B2

(12) United States Patent
Blocker

(10) Patent No.: US 7,793,485 B2
(45) Date of Patent: Sep. 14, 2010

(54) METHOD OF DISCREET MERCHANDISING

(75) Inventor: Michelle Lee Blocker, Neenah, WI (US)

(73) Assignee: Kimberly-Clark Worldwide Inc., Neenah, WI (US)

( * ) Notice: Subject to any disclaimer, the term of this patent is extended or adjusted under 35 U.S.C. 154(b) by 54 days.

(21) Appl. No.: 12/012,123

(22) Filed: Jan. 29, 2008

(65) Prior Publication Data

US 2009/0188210 A1 Jul. 30, 2009

(51) Int. Cl.
*B65B 61/26* (2006.01)

(52) U.S. Cl. ..... 53/411; 53/415; 53/449; 206/459.5

(58) Field of Classification Search ..... 53/411, 53/415, 449, 131.2, 135.1, 135.2, 136.1, 53/136.4, 171; 206/440, 459.5; 229/921; 40/312; *B65B 61/26*
See application file for complete search history.

(56) References Cited

U.S. PATENT DOCUMENTS

| | | | | |
|---|---|---|---|---|
| 1,290,386 | A * | 1/1919 | Smith | 206/459.5 |
| 2,192,423 | A * | 3/1940 | Ward et al. | 40/312 |
| 3,026,014 | A * | 3/1962 | Cornell et al. | 40/312 |
| 3,335,937 | A * | 8/1967 | Kramer | 206/459.5 |
| 4,393,386 | A | 7/1983 | Di Giulio | |
| 5,542,237 | A * | 8/1996 | Grey et al. | 53/411 |
| 5,967,665 | A | 10/1999 | MacDonald et al. | |
| 6,953,207 | B2 * | 10/2005 | Raming | 40/312 |
| 7,048,308 | B2 * | 5/2006 | Blank | 206/459.5 |
| 2003/0102238 | A1 * | 6/2003 | White et al. | 206/438 |
| 2003/0234199 | A1 * | 12/2003 | Morita et al. | 206/459.5 |
| 2004/0045857 | A1 * | 3/2004 | Gillani | 206/459.5 |
| 2005/0092554 | A1 | 5/2005 | McGillin et al. | |
| 2006/0071061 | A1 * | 4/2006 | Velazquez et al. | 229/225 |
| 2007/0144929 | A1 * | 6/2007 | Minerath et al. | 206/459.5 |

OTHER PUBLICATIONS

Exhibit A—Photograph of cardboard packaging for an incontinence product manufactured by Kendall Health Care, taken Dec. 21, 2007.

Exhibit B—Photograph of cardboard packaging for an incontinence product manufactured by PaperPak, taken Dec. 21, 2007.

Exhibit C—Photograph of cardboard packaging for an incontinence product manufactured by Principle Business Enterprises Inc., taken Dec. 21, 2007.

Exhibit D—Photograph of cardboard packaging for an incontinence product manufactured by SCA Personal Care, taken Dec. 21, 2007.

Patent Cooperation Treaty Search Report from the International Search Authority, International Application No. PCT/IB2009/050182 dated Sep. 29, 2009.

* cited by examiner

*Primary Examiner*—Stephen F Gerrity
(74) *Attorney, Agent, or Firm*—David J. Arteman; Bryan R. Rosiejka

(57) ABSTRACT

A case adapted to contain absorbent articles includes an outer surface having a bar code, a product code, and a single brand display having a trademark in logo, wherein the brand display defines a brand display area of less than 4 inches by 6 inches. A method of providing absorbent articles includes providing a case in a branded condition, wherein the case includes a brand display having a brand display area of no more than 4 inches by no more than 6 inches. The method includes converting the case, or instructing a customer to convert the case, from the branded condition to a discreet condition by covering the brand display with a discretion mask or cleanly removing the brand display.

3 Claims, 2 Drawing Sheets

METHOD OF DISCREET MERCHANDISING

BACKGROUND OF THE INVENTION

There currently exists a variety of absorbent articles that have been developed to improve the health and hygiene of the user. For example, infant diapers, training pants, adult incontinence articles, feminine care articles, and the like are commonly used to absorb urine, menses, and other bodily exudates. However, despite the useful nature of these products, some users desire greater discretion regarding their need for particular absorbent articles. This may be particularly relevant to some adult users with incontinence. As such, some users may obtain absorbent articles by home delivery to avoid the embarrassment or self-consciousness of shopping in a traditional grocery store or drug store.

However, even with home delivery, some users are concerned about the cases of branded product being seen by others during delivery, storage, and/or disposal. To address this need, some manufacturers of absorbent articles ship the products in cases having no visible branding. This addresses the need for discretion but can cause issues with some retailers that want to see the branding on the cases to ensure proper merchandise inventory, transfer, and/or stocking. In order to serve both needs, some manufactures have provided two different case designs to satisfy the needs of the two different customers (i.e., branded cases for the retailers and unbranded cases for home delivery). However, this solution creates logistical and economic inefficiencies by requiring the manufacturer of the absorbent articles to manage two different case designs for a single product code.

Other methods of addressing discretion have included manufactures of absorbent articles providing the same branded cases to both retailers and home delivery providers. In turn, some of the home delivery providers have emptied the cases, turned the cases inside out, and refilled the cases such that the brand is printed on the inside of the case. Transforming the cases in this way eliminates the need for two different case designs but requires additional labor and expense on the part of the home delivery providers. Furthermore, this solution does not address the need for discretion when storing or disposing of the branded case because the branding is still visible on the inner surface of the case.

In other situations when manufactures of absorbent articles provide the same branded cases to both retailers and home delivery providers, the home delivery providers remove the product from the branded cases and repack the product into unbranded cases. This solution addresses the need for discretion during receipt, storage, and disposal of the case but re-introduces the problem of having two different case designs (i.e., branded and unbranded). The only difference is that the expense has transferred from the manufacturer of the absorbent articles to the home delivery provider.

Thus, there exists a need for a single case design that meets the branding requirements of retailers and the discretion requirements of home delivery providers. There also exists a need for a method to use the single case design to satisfy the needs of all customers/retailers.

SUMMARY OF THE INVENTION

In response to these needs, one aspect of the present invention provides a case adapted to contain absorbent articles. The case includes an outer surface having a bar code, a product code, and a single brand display. The brand display has a trademark in logo and the brand display defines a brand display area of less than 4 inches in a first dimension and less than 6 inches in a second dimension.

In some embodiments, the case may be a corrugated material and may have a length of 10 to 25 inches, a width of 5 to 16 inches, and a height of 5 to 17 inches. In some embodiments, the bar code, the product code, and the brand display may be printed on the outer surface of the case with the same ink. In some embodiments the ink may be GCMI.

In some embodiments, the case may be made of corrugated material and the bar code, product code, and the brand display may be printed on the outer surface of the case using the same printing method.

In some embodiments, the case may contain absorbent articles adapted for use by youths or adults with incontinence.

In some embodiments, the brand display may be adapted to be cleanly removed from the outer surface of the case. In some embodiments, the brand display may be printed on a removable branding label and the removable branding label may be joined to a release material. The release material may be joined to the outer surface of the case.

In some embodiments, the bar code and product code may be printed on at least four sides of the case.

In another aspect, the present invention is directed towards a method of providing absorbent articles. The method includes providing a case in a branded condition wherein the case contains absorbent articles therein. The case has an outer surface and an inner surface wherein the outer surface includes a bar code, a product code, and a brand display. The brand display defines a brand display area of no more than 4 inches in a first dimension and no more than 6 inches in a second dimension. The method further includes converting the case from the branded condition to a discreet condition by covering the brand display with a discretion mask or cleanly removing the brand display.

In some embodiments, the outer surface of the case may include a single brand display. In some embodiments, the case may be made of corrugated material and contain at least one package having the absorbent articles located therein. In some embodiments, the package may have a package brand display having at least one trademark that is the same as at least one trademark of the case brand display.

In some embodiments, the brand display may be printed on a removable branding label and the removable branding label may be joined to a release material and the release material may be joined to the outer surface of the case. In these embodiments, the method may further include converting the case to the discreet condition by cleanly removing the removable branding label.

In some embodiments, the discretion mask may be a shipping label and the method may further include converting the case to the discreet condition by placing the shipping label over the brand display.

In another aspect, the present invention is directed towards another method of providing absorbent articles. The method includes providing a case to a customer in a branded condition. The case contains a first type and grade of absorbent articles therein. The case defines an outer surface and an inner surface wherein the outer surface includes a bar code, a product code, and a single brand display. The brand display defines a brand display area and has a first dimension of no more than 4 inches a second dimension of no more than 6 inches. The method further includes instructing the customer to convert the case from the branded condition to a discreet condition by covering the brand display with a discretion mask or by cleanly removing the brand display.

In various embodiments, the discretion mask may be a shipping label and the method may further include instructing the customer to affix the shipping label to the outer surface of the case to cover the brand display and transition the case from the branded condition to the discreet condition.

In some embodiments, the method may further include providing all the first type and grade of absorbent articles to all customers in cases having the same case design and having the same product code.

In some embodiments, the case may be made of corrugated material and may contain at least one package having absorbent articles located within the at least one package. The package may have a package brand display having at least one trademark that is the same as at least one trademark of the case brand display.

In some embodiments, the brand display may be printed on a removable branding label and the removable branding label may be joined to a release material and the release material may be joined to the outer surface of the case. In these embodiments, the method further includes instructing the customer to convert the case to the discreet condition by cleanly removing the removable branding label.

DETAILED DESCRIPTION OF THE DRAWINGS

The present invention is directed to cases and methods for packaging and shipping absorbent articles that address the desire for enhanced discretion amongst the users of the absorbent articles and to address the branding requirements of some retailers. Specifically, the present invention allows users to discreetly receive cases of absorbent articles without displaying evidence of incontinence. Furthermore, the present invention also allows users to conceal the nature of the absorbent articles during storage and disposal of the packaging. Furthermore, the present invention enables absorbent article manufacturers to provide all retailers and home delivery providers with a single case design that meets the needs of both of these customers.

Figure 1:
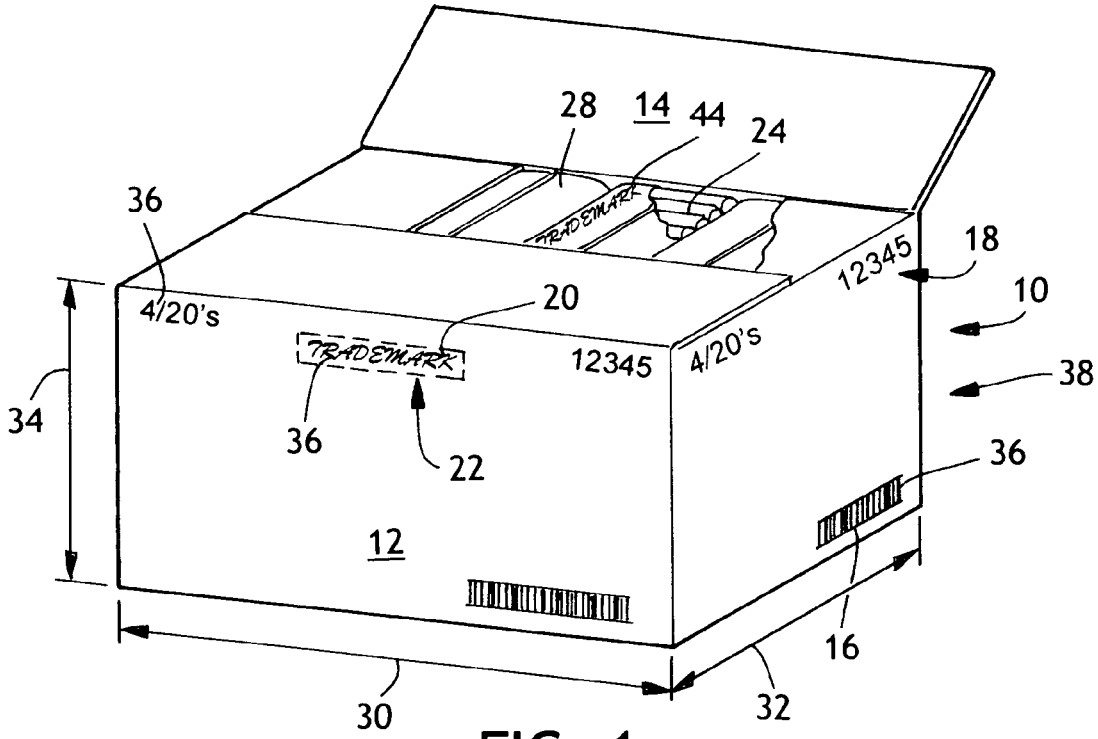
FIG. 1 representatively illustrates an exemplary case of the present invention in the branded condition with packages of absorbent articles contained therein.

In one aspect, the present invention is directed to a case adapted to contain absorbent articles as representatively illustrated in FIG. 1. In FIG. 1 an exemplary case 10 is shown in a perspective view in a partially opened configuration and having portions cut away to better illustrate underlying elements. The case 10 has an outer surface 12 and an inner surface 14. The outer surface 12 may include a bar code 16, a product code 18, and/or a brand display 20. The brand display 20 defines a brand display area 22. In some embodiments, the outer surface 12 may include only a single brand display 20.

As used herein, the term "brand display" refers to the visual presentation of one or more trademarks on the surface of a case wherein the one or more trademarks are associated with the absorbent articles contained within the case. The one or more trademarks may be words, letters, designs, symbols, or the like, or combinations thereof. Trademarks identify goods of a manufacturer, merchant, or authorized licensee and differentiate said goods from those of competitors. Trademarked words or letters may be in block letters, in plain text, in logo, or the like, or combinations thereof. As used herein, the term "in logo" refers to a trademarked word, phrase, and/or letters presented in a distinctive style, script, and/or font. In other words, the term "in logo" describes stylized writing and is distinguished from block letters and/or plain text.

In some embodiments, the brand display may also include one or more product names. As used herein, the term "product names" refers to generic words provided with trademarked words to provide additional information as to the specific type of product with which the trademarked words are associated. For example, product names may include such words as: absorbent products, shields, undergarments, underpads, stretch briefs, wipes, guards, absorbent underwear, underwear, guards for men, and the like, and combinations thereof.

The brand display area 22 is defined as the smallest continuous area that can encompass the entire brand display 20. Thus, if the brand display 20 includes two or more distinct trademarks or product names, the brand display area 22 is the smallest continuous area that can cover all the trademarks and all the product names. For example, in FIG. 1, the brand display 20 includes a single trademarked word in logo. Thus, the brand display area 22 is the smallest continuous area that can encompass the entire brand display 20. The brand display area 22 in FIG. 1 is representatively illustrated as a dashed-line rectangle.

In various embodiments, the brand display area 22 may be any suitable size and/or shape. In some embodiments, the brand display area 22 is sized and shaped so as to be covered by a single discretion mask 42. In various embodiments, the discretion mask 42 may be any object suitable for obscuring the brand display 20 and thereby enhancing the discretion of the case. For example, a discretion mask 42 may be a shipping label or product pick up label. For example, some common carriers including the United States Postal Service (USPS), United Parcel Service (UPS), Federal Express (FedEx), DHL, and the like utilize standardized shipping labels that have a size of about 4 inches by about 6-inches. Thus, in some embodiments, the brand display area 22 is equal to or less than 4 inches in a first dimension and equal to or less than 6 inches in a second dimension. In some embodiments, the brand display area 22 is less than 24 inches square. In various embodiments, the brand display area 22 may be any suitable shape. For example, the brand display area 22 may have a shape that is rectangular, circular, oval, polygonal, irregular, or combinations thereof.

As used herein, the term "first dimension" refers to the longest measurement of the brand display area 22 in a direction generally parallel with the length direction or the width direction of the side of the case on which the brand display is located. As used herein, the term "second dimension" refers to the longest measurement of the brand display area 22 in a direction generally perpendicular to the first dimension.

In various embodiments, the case 10 may be made of any suitable material. For example, the case 10 may be made of corrugated material, plastic, metal, paperboard, cardboard, and the like, and combinations thereof. Many manufacturers of disposable absorbent articles utilize corrugated material that is stored flat and then opened and secured in the shape of a box by tape, adhesive, staples, or the like, or combinations thereof.

In various embodiments, the case 10 is adapted to contain absorbent articles 24 therein as illustrated in FIG. 1. As used herein, the term "absorbent articles" refers to products adapted for use as adult incontinence products, feminine hygiene products, infant incontinence products, child incontinence products, youth incontinence products, and the like.

For example, absorbent articles for adult incontinence may include adjustable underwear, briefs, panties, pads, liners, bed liners, inserts, guards, and the like. Incontinence products for infants, children, and youth may include diapers, pants, boxers, training pants, sleep shorts, bed pads, and the like. Feminine hygiene products may include products adapted to contain and/or absorb urine, menses, and/or other bodily exudates. For example, feminine hygiene articles may include pads, tampons, napkins, liners, panties, and the like.

As used herein, the term "adapted to contain absorbent articles" refers to cases that are sized to hold one or more absorbent articles therein and are made of a material or materials suitable for transporting absorbent articles in normal commerce. For example, as illustrated in FIG. 1, the absorbent articles 24 are often compressed and contained within plastic bags 26 creating a package 28 having a generally rectangular shape. A case of the present invention is "adapted to contain absorbent articles" if the case is made with dimensions that accommodate an integer number of packages 28 with little or no wasted space in the length 30, the width 32, or the height 34 dimension and is made of material suitable for standard shipping practices.

The case 10 may have any suitable length, width, and height. In some embodiments the case 10 may have a length 30 of 10 to 25 inches, a width 32 of 5 to 16 inches, and a height 34 of 5 to 17 inches. In a specific embodiment, the case 10 may have dimensions of about 24 inches by 12.5 inches by 9.7 inches.

In various embodiments, the case 10 may include printed indicia 36 on the outer surface 12 and/or the inner surface 14. For example, the printed indicia 36 may include the bar code 16, the product code 18, the brand display 20, a product name, a product description, a best use date, a lot code, an expiration date, the item configuration, the net weight, the quantity, the container type, the manufacturer information, the handling instructions, the storage instructions, the pallet pattern, the recycle information, the opening instructions, and other suitable markings, and any combination thereof. In various embodiments, some or all of the printed indicia 36 may be applied to the cases by a case manufacturer and/or case printer. In other embodiments, some or all of the printed indicia 36 may be applied to the cases by the absorbent article manufacturer. In various embodiments, some of the printed indicia 36 may be applied to the cases by the case manufacturer and/or the case printer and some of the indicia 36 may be applied by the absorbent article manufacturer.

In various embodiments the printed indicia 36 may be applied by any suitable means. For example, the printed indicia 36 may be applied by flexography printing, lithography printing, screen printing, letter press printing, digital printing, laser printing, jet printing, and the like, and combinations thereof. Flexography printing is also referred to as flexographic printing or direct printing and is a relief printing technique that employs rubber or soft plastic plates, a simple inking system, and fast-drying inks.

In some embodiments, the product bar code 16, the product code 18, and the brand display 20 are all printed on the outer surface 12 of the case 10 with the same type of ink 38. In various embodiments, the ink 38 may be fast drying water-based inks such as GCMI or those available from Pantone Graphics.

In some embodiments, the bar code 16, the product code 18, and the brand display 20 are all applied to the outer surface 12 of the case 10 using the same printing method. For example, in some embodiments, the bar code 16, the product code 18, and the brand display 20 are applied to the outer surface 12 of the case 10 by flexography printing and using GCMI or Pantone Graphics inks.

Figure 3:
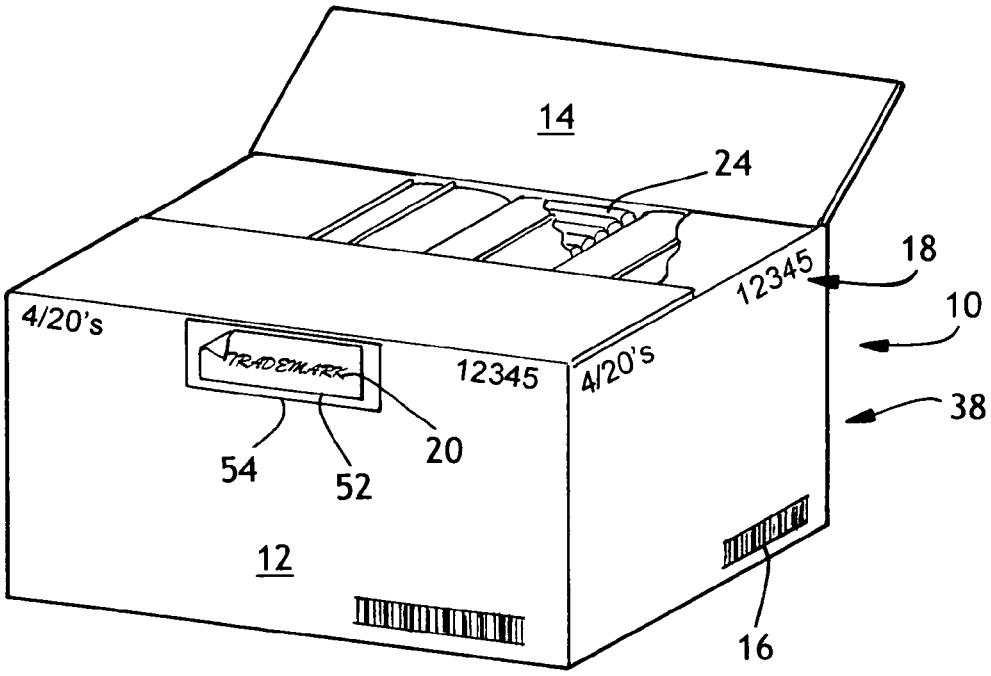
FIG. 3 representatively illustrates an exemplary case of the present invention in the branded condition with packages of absorbent articles contained therein.
Figure 4:
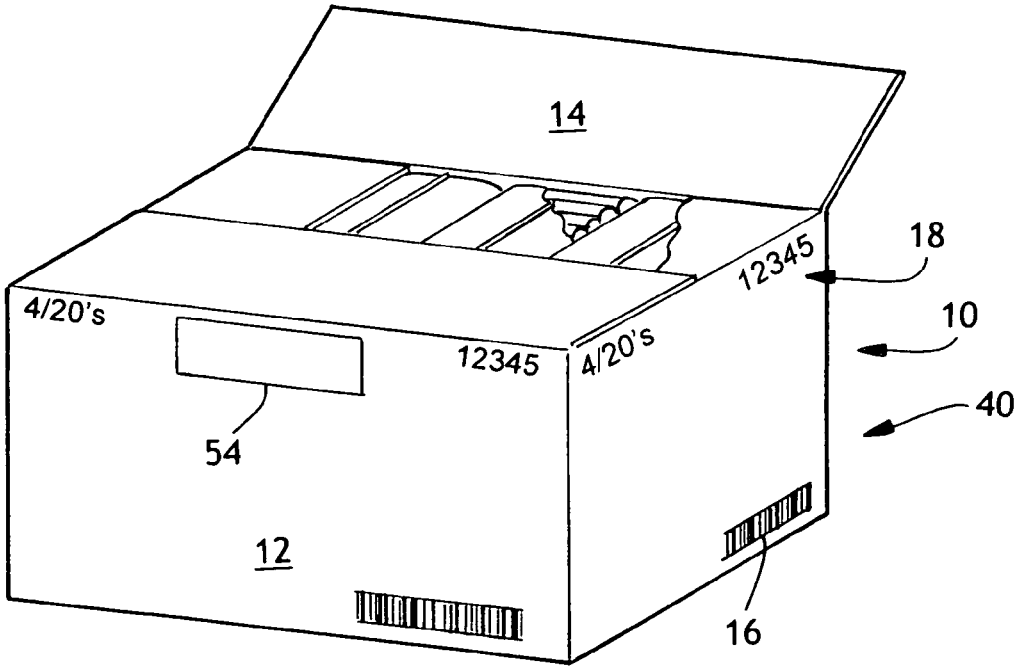
FIG. 4 representatively illustrates the case of FIG. 3 after conversion to the discreet condition.

In some embodiments, the brand display 20 is adapted to be cleanly removed from the outer surface 12 of the case 10. As used herein, the term "cleanly removed" describes a brand display that can be separated from the case 10 without damaging the case. For example, and as illustrated in FIG. 3, a brand display 20 may be printed on a removable branding label 52 that is releasably attached to a release material 54 which in turn is joined to the case 10. The release material 54 may be joined to the case with adhesive or by any other suitable means. Case 10, as illustrated in FIG. 3, is in the branded condition 38. The removable branding label 52 with the brand display 20 may be removed from the release material 54 without causing damage to the case 10 and can therefore be "cleanly removed." Removing the removable branding label 52 from the case 10 converts the case 10 to a discreet condition 40 as illustrated in FIG. 4. In contrast, an adhesive label adhered to the case 10 that tears an outer layer of material from the case 10 when removed is not adapted to be "cleanly removed." Additionally, a brand display 20 printed directly on the case 10 is not adapted to be "cleanly removed."

In some embodiments, the bar code 16 and/or the product code 18 and/or the brand display 20 may be presented on one, two, three, four, five, or six sides of the case. In some embodiments, the brand display 20 is presented on only one side of the case and the bar code 16 and/or the product code 18 are printed on at least one, at least two, at least three, at least four, or at least five sides of the case 10.

In another aspect, the present invention includes a method of providing absorbent articles. The method includes providing any of the cases 10 described herein or any other suitable case adapted to contain absorbent articles in a branded condition 38. The case 10 defines an outer surface 12 and an inner surface 14. In the branded condition 38, the outer surface 12 of the case 10 includes a brand display 20. In some embodiments, the case 10 includes only a single brand display 20. The brand display 20 defines a brand display area 22 of no more than 4 inches in a first dimension by no more than 6 inches in a second dimension.

Figure 2:
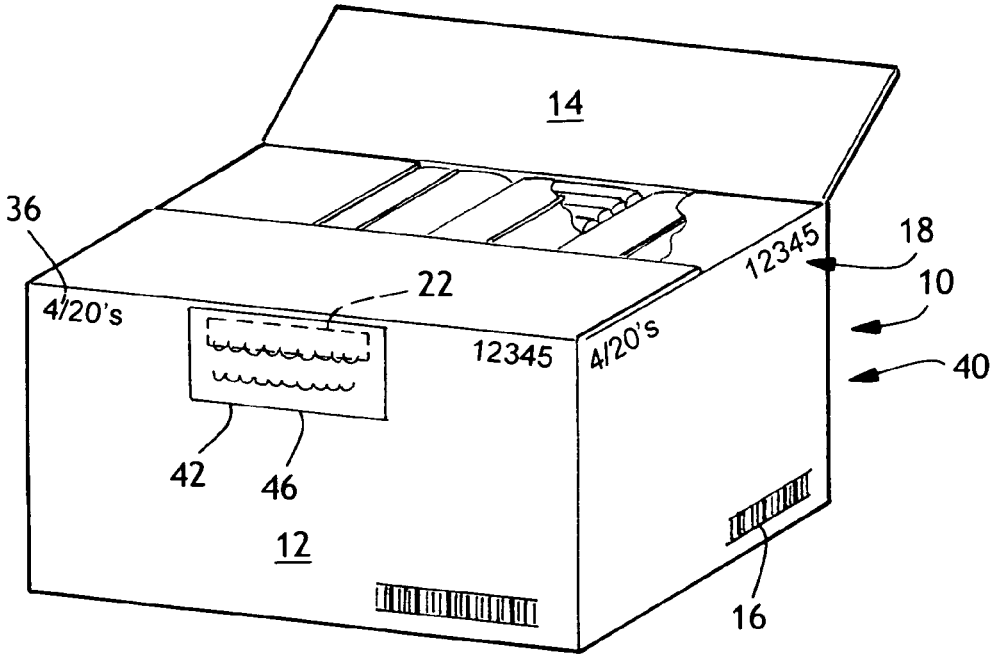
FIG. 2 representatively illustrates the case of FIG. 1 after conversion to the discreet condition.

The method further includes converting the case 10 from the branded condition 38 to a discreet condition 40 by covering the brand display 20 with a discretion mask 42 or cleanly removing the brand display 20. In the discreet condition 40, the case 10 has no visible brand display 20 on either the outer surface 12 or the inner surface 14. For example, FIG. 1 representatively illustrates a case 10 with brand display 20 visible on the outer surface 12 defining a branded condition 38. The case 10 can be converted to a discreet condition 40 by covering the brand display 20 with a discretion mask 42 as illustrated in FIG. 2. In another example, FIG. 3 representatively illustrates a case 10 with brand display 20 visible on a removable branding label 52 which is joined to a release material 54 which is joined to the outer surface 12 defining a branded condition 38. The case 20 can be converted to a discreet condition 40 by removing the removable branding label 52, which includes the brand display 20, from the release material 54 as illustrated in FIG. 4.

In some embodiments, the method includes providing at least one package 28 within the case 10 wherein the package 28 includes absorbent articles 24 located therein. In some embodiments, the package 28 may include a package brand display 44 that includes one or more trademarks that are the same as one or more trademarks in the case brand display 20 as exemplarily illustrated in FIG. 1.

In some embodiments, the case 10 has a brand display area 22 having a first dimension of less than or equal to 4 inches and a second dimension of less than or equal to 6 inches. In some embodiments, a discretion mask 42 may be placed over the entire brand display area 22 thereby converting the case 10 to the discreet condition 40 in a single step. In some embodiments, the discretion mask 42 may be a shipping label 46 wherein the shipping label has a first dimension of at least 4 inches and a second dimension of at least 6 inches.

In another aspect, the present invention includes another method of providing absorbent articles 24. The method includes providing a first plurality of cases having a first case design to a first customer in a branded condition 38. The first case design may be in accord with any of the cases described herein or any other suitable case design. In the branded condition 38, the first plurality of cases may contain absorbent articles therein, the first plurality of cases may have an outer surface and an inner surface wherein the outer surface includes a single brand display 20. The brand display 20 defines a brand display area 22 having a first dimension of less than or equal to 4 inches and a second dimension of less than or equal to 6 inches.

The method may further include instructing the first customer to convert at least one of the first plurality of cases from the branded condition 38 to a discreet condition 40 by covering the brand display 20 with a discretion mask 42 or by cleanly removing the brand display 20.

In various embodiments, the discretion mask 42 may be a shipping label 46 and the method may further include instructing the first customer to affix the shipping label 46 to the outer surface 12 of the case 10 to cover the brand display 20 and thus transition the case 10 from the branded condition 38 to the discreet condition 40.

In some embodiments, the method may further include providing a second plurality of cases having a second case design to a second customer in the branded condition 38 wherein the second case design is the same as the first case design. In other words, the outer surface printing of the first plurality of cases is the same as the outer surface printing of the second plurality of cases.

By employing this method, a manufacturer of absorbent articles can provide a particular code of absorbent articles to all retailers and/or customers using a single printing design on the cases. Some retailers/customers may receive the case, open the case, and remove the bags of products for display and sale in their stores. Other retailers/customers may receive the case, convert the case to the discreet condition, and deliver the case of product to another party.

While the invention has been described in detail with respect to specific embodiments thereof, it will be appreciated that those skilled in the art, upon attaining understanding of the foregoing will readily appreciate alterations to, variations of, and equivalents to these embodiments. Accordingly, the scope of the present invention should be assessed as that of the appended claims and any equivalents thereto. Additionally, all combinations and/or sub-combinations of the disclosed embodiments, ranges, examples, and alternatives are also contemplated.

The invention claimed is:

1. A method of providing absorbent articles comprising, providing a case in a branded condition, wherein the case contains absorbent articles therein, the case having an outer surface and an inner surface wherein the outer surface comprises a bar code, a product code, and a single brand display, wherein the brand display defines a brand display area of no more than 4 inches in a first dimension by no more than 6 inches in a second dimension, and wherein the case is made of corrugated material and contains at least one package having the absorbent articles located therein;

converting the case from the branded condition to a discreet condition by adhering a shipping label over the brand display.

2. The method of claim 1 wherein the package has a package brand display comprising at least one trademark that is the same as at least one trademark of the case brand display.

3. A method of providing absorbent articles comprising, providing a case in a branded condition, wherein the case contains absorbent articles therein, the case having an outer surface and an inner surface wherein the outer surface comprises a bar code, a product code, and a brand display, wherein the brand display defines a brand display area of no more than 4 inches in a first dimension by no more than 6 inches in a second dimension, and converting the case from the branded condition to a discreet condition by covering the brand display with a discretion mask or cleanly removing the brand display;

wherein the outer surface comprises a single brand display; and wherein the discretion mask is a shipping label and the method further comprises converting the case to the discreet condition by adhering the shipping label over the brand display.

* * * * *